US006686000B2

(12) United States Patent
Ichinose

(10) Patent No.: US 6,686,000 B2
(45) Date of Patent: Feb. 3, 2004

(54) RECORDING MEDIUM AND IMAGE FORMING METHOD

(75) Inventor: Hirofumi Ichinose, Kawasaki (JP)

(73) Assignee: Canon Kabushiki Kaisha, Toyko (JP)

( * ) Notice: Subject to any disclaimer, the term of this patent is extended or adjusted under 35 U.S.C. 154(b) by 153 days.

(21) Appl. No.: 09/742,326

(22) Filed: Dec. 22, 2000

(65) Prior Publication Data

US 2001/0028382 A1 Oct. 11, 2001

(30) Foreign Application Priority Data

Dec. 27, 1999 (JP) ..... 11-370099

(51) Int. Cl.[7] ..... B41M 5/00; B41J 2/01

(52) U.S. Cl. ..... 428/32.32; 428/32.34; 428/32.38; 347/105

(58) Field of Search ..... 428/175, 32.32, 428/32.34, 32.38; 347/105

(56) References Cited

U.S. PATENT DOCUMENTS

| | | | | |
|---|---|---|---|---|
| 4,242,271 | A | 12/1980 | Weber et al. | 260/448 |
| 4,723,129 | A | 2/1988 | Endo et al. | 346/1.1 |
| 5,725,961 | A | 3/1998 | Ozawa et al. | 428/500 |
| 5,910,359 | A | 6/1999 | Kobayashi et al. | 428/327 |

FOREIGN PATENT DOCUMENTS

| | | | |
|---|---|---|---|
| EP | 0 749 845 | A2 | 12/1996 |
| EP | 0 908 324 | A1 | 4/1999 |
| JP | 54-59936 | A | 5/1979 |
| JP | 59-22683 | A | 2/1984 |
| JP | 59-222381 | A | 12/1984 |
| JP | 2-276670 | A | 11/1990 |
| JP | 4-101880 | A | 4/1992 |
| JP | 9-099634 | A | 4/1997 |
| JP | 9-156211 | A | 6/1997 |
| JP | 9-324053 | A | 12/1997 |
| JP | 10-324053 | A | 12/1997 |
| JP | 11-192775 | A | 7/1999 |

*Primary Examiner*—Pamela R. Schwartz
(74) *Attorney, Agent, or Firm*—Fitzpatrick, Cella, Harper & Scinto

(57) ABSTRACT

A recording medium comprises a base member and at least a porous organic resin layer formed on the base member. The porous organic resin layer includes organic fine particles having both hydrophilic radicals and hydrophobic radicals, a water-absorbing binder and voids. The layer shows a pore size distribution having a highest peak found within a pore radius range between 3 nm and 300 nm, a pore volume of 0.2 $cm^3/g$ or more and a pH value of 5.2 or higher as observed by a method conforming to JIS P 8133. The layer is typically formed by applying to the base member a coating formulation of aqueous dispersion containing such organic fine particles, a water-absorbing binder and a basic substance and showing a pH value of 5.2 or higher as observed by a method conforming to JIS Z 8802, followed by drying.

13 Claims, 2 Drawing Sheets

RECORDING MEDIUM AND IMAGE FORMING METHOD

BACKGROUND OF THE INVENTION

1. Field of the Invention

This invention relates to a recording medium having a porous organic resin layer on a base member and a method of manufacturing the same. The present invention also relates to an image forming method for forming images on such a recording medium preferably by means of an ink-jet recording method.

2. Related Background Art

Ink-jet recording systems are adapted to record images and/or characters on a recording medium (such as paper) by ejecting fine droplets of ink based on any of the currently known various operation principles. An ink-jet recording system provides advantages including high speed printing, a low noise emission level, adaptability to multi-color printing, versatile recording pattern forming capabilities and elimination of development and fixing processes and therefore has been finding an increasingly large number of applications. Furthermore, currently known multi-color ink-jet recording systems can form multi-color images with an image quality comparable to that of color images printed by using a color photography system at cost lower than ordinary color printing if the number of copies is relatively small. Therefore, they are being used also in the field of full color image recording.

While improvements have been made to ink-jet recording apparatus and ink-jet recording methods to meet the demand for a higher recording speed, a higher image definition and a higher full color image quality, such a rigorous demand has also been directed to the recording medium to be used for ink-jet recording. For the ink-jet recording system, ink containing an aqueous solvent that may be water or a mixed solution of water and an organic solvent to a large extent is normally used because ink droplets have to be ejected at high speed from nozzles toward the recording medium. For recording color images with a high color density, it is therefore necessary to use ink at a high rate. On the other hand, the beading phenomenon of combined and fused ink dots can appear to disturb the image printing operation because ink droplets are ejected continuously. To prevent the beading phenomenon, the recording medium to be used with the ink-jet recording system is required to absorb ink at a high rate and to a large extent.

Various forms of recording medium have been proposed to meet the above listed requirements. For instance, a variety of types of recording medium having thereon a porous layer containing inorganic particles (of alumina hydrate, etc.) have been proposed to improve the recording medium in terms of ink absorption, coloring and the resolution of the printed image. Such proposals include the one described in Japanese Patent Application Laid-Open No. 2-276670. On the other hand, Japanese Patent Application Laid-Open No. 4-101880 proposes various different types of recording medium prepared by forming an ink fixing layer of transparent resin that dissolves into liquid or swells by absorbing the solvent contained in ink.

Both Japanese Patent Applications Laid-Open Nos. 59-22683 and 59-222381 propose a recording medium having a layer made of thermoplastic resin particles, emulsion and latex formed on a base member. Japanese Patent Application Laid-Open No. 11-192775 describes a recording medium adapted to be used with pigment ink and invented by the inventor of the present invention.

Furthermore, Japanese Patent Application Laid-Open No. 9-99634 describes a recording medium having an ink receiving layer made of a polymer complex obtained by dissolving a binding agent containing a basic polymer and styrene/(meth)acrylic acid copolymer and organic particles and mixing them.

Japanese Patent Application Laid-Open No. 9-156211 describes a recording medium having an ink receiving layer that is formed on a transparent support member and made of fine particles of a crosslinked polymer having an average particle diameter of less than 200 nm and water-soluble resin, the recording medium showing a transmissivity per sheet of more than 80%.

Japanese Patent Application Laid-Open No. 10-324053 describes a recording medium having a porous film coat formed by using emulsion containing carboxycellulose nitrate and a film forming aid.

While the above described prior art provides various types of recording medium that are improved in terms of ink absorption, the resolution of the image formed on it, image density, transparency and gloss, they are accompanied by a number of problems that have arisen as a result of the remarkable recent improvements of recording apparatus that make it possible to print quality images comparable to those of silver photography at high speed.

For instance, while the recording medium having a porous layer of inorganic particles (of alumina hydrate, etc.) on the surface is advantageous in terms of the quality of the image formed on it and gloss, it can easily be damaged during transportation depending on the method of carrying it because the surface is highly vulnerable to damages. Additionally, when it is made transparent so as to be used as OHP film, it can produce its own shadow even if it is highly transparent and relatively free from haze because of the porous layer that is made of a combination of inorganic particles and organic resin. This problem may probably be due to the difference of refractive index between the inorganic particles, the organic resin and the pores. Still additionally, when pigment ink is used to print images on it, the pigment can form a deposit on the surface that is not absorbed by the porous layer because the pores of the porous layer is small relative to the pigment particles in the ink, whereby the surface smoothness becomes lost and the rub-off resistance is decreased. Furthermore, the recording medium can give rise to an additional problem of yellow discoloration that is specific to a recording medium carrying thereon a porous layer mainly made of such inorganic particles.

A recording medium having an ink fixing layer made of resin that dissolves into liquid or swells by absorbing the solvent contained in ink as disclosed in Japanese Patent Application Laid-Open No. 4-101880 is accompanied by a problem that the ink applied to it does not dry quickly but remains sticky after the application. Additionally, the ink receiving layer does not show a sufficient level of water-resistance and some of the ink applied to it can migrate when the dye of the ink is affected by moisture. Still additionally, cracks can occur in the printed areas (particularly in solidly printed areas) of the recording medium when a pigment is used as the coloring agent of ink because the ink receiving layer lacks water-resistance.

While a recording medium comprising an ink receiving layer made of thermoplastic resin particles, emulsion and latex formed on a base member as disclosed in Japanese Patent Application Laid-Open No. 59-22683 and 59-222381 shows a high ink absorption rate, the absorption of ink relies only on the gaps separating the thermoplastic resin particles and hence a thick ink receiving layer has to be used to obtain a sufficiently high ink absorption ability. Then, there arises a problem of reduced transparency and strength of the film layer. While Japanese Patent Application Laid-Open No. 11-192775 proposes an improved recording medium that is highly adaptable to the use of pigment ink, it has a configuration based on a concept that is totally different from the present invention because it has to be subjected to a heat treatment after the image forming process.

In the case of a recording medium having an ink receiving layer made of a polymer complex of a combination of a binding agent and organic particles as described in Japanese Patent Application Laid-Open No. 9-99634, pores formed in the ink receiving layer are not satisfactory for achieving a high ink absorption rate because the binding agent and the organic particles are dissolved in solvent firstly and then the obtained polymer complex is used to form the ink receiving layer.

It is also difficult to satisfactorily raise the ink absorption rate of a recording medium having an ink receiving layer that is formed on a transparent support member and made of fine particles of a crosslinked polymer having an average particle diameter of less than 200 nm and water-soluble resin as disclosed in Japanese Patent Application Laid-Open No. 9-156211 because the water-soluble resin is used as binding agent and hence it is impossible to provide sufficiently large gaps among the fine particles of the polymer and additionally because water-soluble resin is used at a ratio between 1:1 and 1:10 relative to fine particles.

Finally, in the case of a recording medium having a porous film coat formed by using emulsion containing carboxycellulose nitrate and a film forming aid as disclosed in Japanese Patent Application Laid-Open No. 10-324053, while gaps are satisfactorily formed among the fine particles of the emulsion, it is difficult to regulate the pH value in the porous film coat layer and, if the pH value is low and the layer is acidic, the dye contained in the ink can agglomerate in a peculiar way to alter their original tints after the printing operation.

SUMMARY OF THE INVENTION

In view of the above identified technological problems of the prior art, it is therefore the object of the present invention to provide a recording medium that is improved in terms ink absorption rate, non-stickiness, transparency, ability for fixing pigment ink, prevention of cracks in printed areas and color reproducibility for dye ink and satisfactory for forming images in terms of image density, gradation, water-resistance and ink fixation, as well as a method of manufacturing such a recording medium and a recording method adapted to record images on such a recording medium.

According to the present invention, the above object is achieved by providing a recording medium comprising a base member and at least a porous organic resin layer formed on the base member;

the porous organic resin layer including organic fine particles having both hydrophilic radicals and hydrophobic radicals, a water-absorbing binder and voids;

the porous organic resin layer showing a pore size distribution having the highest peak found within the pore radius range between 3 nm and 300 nm, a pore volume of 0.2 $cm^3/g$ or more and a pH value of 5.2 or higher as observed by a method conforming to JIS P 8133.

According to the invention, there is also provided a method of manufacturing a recording medium having a base member and at least a porous organic resin layer formed on the base member, the method comprising:

a step of forming the porous organic resin layer by applying to the base member and drying a coating formulation of aqueous dispersion containing organic fine particles having both hydrophilic radicals and hydrophobic radicals, a water-absorbing binder and a basic substance and showing a pH value of 5.2 or higher as observed by a method conforming to JIS Z 8802.

According to the present invention, there is also provided an image forming method for forming an image by applying ink to a recording medium according to the invention, the method preferably using an ink-jet recording method for applying ink to the recording medium.

DESCRIPTION OF THE PREFERRED EMBODIMENTS

Now, the present invention will be described in greater detail by way of preferred embodiments and by referring to the accompanying drawings.

Figure 1:
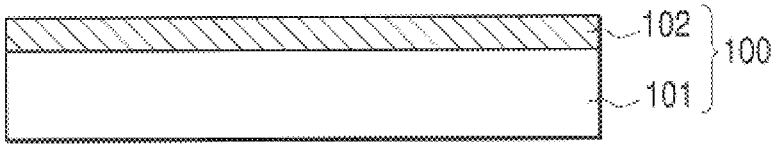
FIG. 1 is a schematic cross sectional view of an embodiment of recording medium according to the invention.

FIG. 1 is a schematic cross sectional view of an embodiment of recording medium according to the invention. The embodiment of recording medium that is generally denoted by reference numeral 100 comprises a base member 101 and a porous organic resin layer 102 formed on the base member 101 to produce a multilayer structure. The base member 101 may be of any known type. Examples of base members that can be used for the purpose of the present invention include sheets of various plastic materials including those of polyesters such as polyethyleneterephthalate, polycarbonates and fluorine type resins such as ETFE (ethylene tetrafluoroethylene copolymer), sheets of paper that are specifically treated such as printing paper for silver photography, baryta paper and resin coat paper, and those of plain paper whose surfaces are not treated, of which plastic sheets having a highly smooth surface can suitably be used as base members because they can enhance the surface gloss of the porous organic resin layer formed thereon. A recording medium formed by using such a base member can be utilizes as glossy film sheet. A transparency type recording medium such as an OHP sheet can be realized by using a transparent base member.

The porous organic resin layer 102 to be formed on the surface of such a base member is mainly made of an organic resin material prepared by combining organic fine particles that are hardly molten by heat and a water-absorbing binder and containing voids therein. With a recording medium 100 according to the invention and having such a configuration, an image can be recorded simply by applying ink onto the porous organic resin layer 102. As ink is applied onto the porous organic resin layer 102, the solvent of the ink firstly passes through the voids in the porous organic resin layer 102 and the water-absorbing binder found among the organic fine particles operate to absorb ink to give rise to a multi-stage ink absorption effect.

In a recording medium according to the invention, the voids in the porous organic resin layer 102 are pores with such sizes that the pore size distribution curve shows the highest peak within the pore radius range between 3 nm and 300 nm. The porous organic resin layer 102 cannot absorb ink satisfactorily if the pore size distribution curve of the porous organic resin layer 102 shows the highest peak at a pore radius smaller than 3 nm, whereas the applied ink can become blurred if the pore size distribution curve of the porous organic resin layer 102 shows the highest peak at a pore radius greater than 300 nm. Preferably, the highest peak of the porous organic resin layer is found within the pore radius range between 7 nm and 100 nm in order to provide a satisfactory level of ink absorption and transparency. The ink absorption per unit volume of the porous organic resin layer 102 can be regulated by controlling the pore size distribution of the voids in the porous organic resin layer and the film thickness of the layer. For the purpose of the present invention, the volume of the pores is preferably greater than 0.2 $cm^3/g$, more preferably greater than 0.5 $cm^3/g$ and smaller than 1.0 $cm^3/g$, in order to raise the rate of ink absorption.

The term "voids" as used herein refer to those of a pore structure formed in the porous organic resin layer where pores are linked vertically and horizontally to produce a two-dimensional or three-dimensional pore arrangement. With such a pore structure, the solvent of the ink applied to the porous organic resin layer can quickly pass through the pores. Note that the pore size distribution of the voids in the porous organic resin layer 102 is determined by a nitrogen adsorption/desorption method.

Voids can be formed optimally in the porous organic resin layer by appropriately selecting the type of organic fine particles to be used for the purpose of the invention, their sizes and profiles, the type of water-absorbing binder to be used for the purpose of the invention and the mixing ratio of the water-absorbing binder relative to the organic fine particles and controlling the drying condition for forming the porous organic resin layer and the thickness of the layer. Then, the porous organic resin layer allows the solvent of the ink applied to it to pass and become absorbed satisfactorily to establish a sufficient level of ink absorbing effect.

Organic fine particles to be used for the purpose of the present invention refer to those of organic pigment that are not substantially plasticized by heat. Additionally, organic fine particles to be used for the purpose of the present invention have both hydrophilic radicals and hydrophobic radicals. As a result, they can be mixed well with an aqueous resin solution of any desired type when preparing a coating formulation. Furthermore, the water-resistance of the porous organic resin film to be formed can be secured by appropriately controlling the ratio of the hydrophilic radicals to the hydrophobic radicals. Specific examples of resins that can be used for the purpose of the invention include those of acryl, polyester, vinyl chloride, vinyl acetate, styrene, butadiene and cellulose types with or without chemical modification. For instance, derivatives of such resins including esters and ethers thereof may also be used for the purpose of the invention.

For the purpose of the present invention, preferably, organic fine particles that are formed by means of an emulsion polymerization technique using a nonionic or cationic emulsifier in a state dispersed in the solvent are preferably used. Specifically, one or more than one compounds obtained by introducing a highly hydrophilic substituent are selected and emulsion polymerized by mixing them with an emulsifier, water and an organic solvent to produce organic fine particles.

Such organic fine particles preferably show a refractive index between 1.40 and 1.60 in order to form a porous organic resin layer without reducing the transparency by combining it with the binder.

For producing pores with desired sizes in the porous organic resin layer, the organic fine particles preferably show a glass transition temperature Tg that makes them hardly molten by heat. The porous organic resin layer formed on the base member will be dried by heating it to above 100° C. because the film layer is securely established by the bonding effect of the binder that becomes apparent when it is heated. Therefore, the glass transition temperature of the organic fine particles to be used for the purpose of the invention should be higher than the heating temperature and preferably between 120° C. and 220° C.

Of the above listed compounds that can be used for the organic fine particles, one obtained by emulsion polymerizing a monomer of the acryl type or the cellulose type is preferably used from the viewpoint of lower refractive index and high Tg. Specific examples of materials that can be used for organic fine particles for the purpose of forming a recording medium according to the present invention include carboxycellulose nitrate described in Japanese Patent Application Laid-Open No. 9-324053.

Preferably, organic fine particles with a diameter found within a range between 5 nm and 300 nm are used for the purpose of the invention in order to produce pores for the voids that scarcely scatters light as pointed out above. A sufficient number voids cannot be produced if the particle diameter is too large whereas the influence of the scatter of light can be serious and the transparency of the porous organic resin layer can be reduced if the particle diameter is too small. More preferably, organic fine particles with a diameter found within a range between 5 nm and 250 nm are used for the purpose of the invention.

Note that a popular method such as a quasi-elastic laser scattering method (dynamic light scattering method) is used for determining the diameters of organic fine particles for the purpose of the invention. Additionally, unlike conventional recording media comprising a porous layer containing inorganic particles, the sheet of a recording medium according to the invention hardly shows yellow discoloration and a phenomenon of whitening that can appear around the printed areas during the process of ink absorption because of the use of organic fine particles.

As described above, in a recording medium according to the invention, organic fine particles made of the above described material and having the above particle diameter are anchored by the binder to produce voids in the porous organic resin layer. Preferably, the organic fine particles of the porous organic resin layer show a complex profile that is rich in undulations on the surface in order to produce more voids in the layer. Organic fine particles can be formed typically by means of a technique of using existing fine particles as seeds and causing them to absorb monomers or that of modifying the surface of fine particles.

Preferably, porous organic fine particles are used for the purpose of the present invention in order to raise the ratio of the voids in the porous organic resin layer. Specific techniques that can be used for forming porous organic fine particles include a method of introducing a crosslinking ingredient and producing a crosslinked structure in them when forming the organic fine particles. For the ratio of the voids in the porous organic resin layer of a recording medium according to the invention, a value that does not adversely affect the transparency of the layer is preferably selected on the basis of the relationship between the ratio and the particle diameter. If the particle diameter is found within the above defined range, the porous organic resin layer can effectively absorb the ink applied to it and the transparency of the film layer can be maintained when the void ratio is between 5 and 70%.

As the emulsifier to be used for the emulsion polymerization process for forming organic fine particles, an anionic emulsifier, a nonionic emulsifier or a cationic emulsifier can be used solely or in combination. Particularly, if the recording medium according to the invention is used for ink-jet recording that normally involves the use of anionic ink for the purpose of image formation, the emulsifier to be used for the emulsion polymerization process is preferably cationic as opposed to anionic so that the porous organic resin layer may be cationic to fix applied ink effectively. While the ink fixing effect may be improved by separately adding a cationic substance, the rate at which the cationic substance can be added may be limited to such an extent that the added substance may not inadvantageously cause gelation or thickening if an anionic emulsifier is used. If such is the case, therefore, a nonionic emulsifier, a cationic emulsifier or a mixture thereof is preferably used.

Organic fine particles to be used for the purpose of the invention structurally contain both hydrophobic radicals and hydrophilic radicals. The porous organic resin layer of a recording medium according to the invention can be made highly water-resistant by using organic fine particles containing hydrophobic radicals. Then, the ink receiving layer of the recording medium is prevented from dissolving to ink and the film coat of the porous organic resin layer can be controlled for its water-resistance if ink is applied thereto, if water drops are sprayed from outside onto the ink applied to the recording medium by ejected from nozzles and/or if the image formed on the recording medium is affected by the ambient humidity. On the other hand, the phenomenon of repelled and/or blurred ink that can occur when ink is applied to the recording medium can be effectively prevented by using organic fine particles containing hydrophilic radicals for the porous organic resin layer. Furthermore, the ink receiving property, the fixing property, the water-resistance, the effect of suppressing the stickiness of the ink receiving layer, the transparency, the coloring effect and other properties of the recording medium can be further improved by using organic fine particles by appropriately controlling the hydrophilicity and the hydrophobicity of the organic fine particles of the porous organic resin layer.

Specific examples of hydrophobic radicals that can be used for the purpose of the invention include ester, allyl, vinyl and propenyl radicals. Hydrophobic radicals may be produced by substituting hydrophilic radicals by a known method. Specific examples of hydrophilic radicals that can be used for the purpose of the invention include anionic radicals such as carboxy, sulfo, hydroxy and phospho radicals as well as cationic radicals such as amino, amido and ethylene imine radicals. Appropriate hydrophilic radicals will be selected from the above listed ones and introduced into organic fine particles in such a way that the degree of hydrophilicity may advantageously be controlled.

The above listed desired properties of organic fine particles to be used for the purpose of the invention can be improved by appropriately combining several substituents, taking the degree of hydrophobicity of each of hydrophobic radical and that of hydrophilicity of each of hydrophilic radical into consideration when designing the structure of the organic fine particles.

The water-absorbing binder that is used with organic fine particles for forming the porous organic resin layer of a recording medium according to the invention is preferably a dispersion where the binding agent is not dissolved in water nor in the solvent and maintains the form of particles (resin emulsion). Dispersions that can be used for the purpose of the invention include aqueous dispersions, dispersions in a mixed solvent of water and alcohol or some other chemical compound, and those in an organic solvent. Acrylic resins, urethanic resins, styrenic resins, butadienic resins, polyesteric resins and mixtures of combinations of any of them, copolymers, composites and other water-absorbing resin emulsions can be used appropriately. Any of the resins of such dispersions may be used with a soluble resin, although the dispersed resin should be predominantly contained. Soluble resins that can be used for the purpose of the invention include water-soluble resins, resins that can be dissolved into a mixed solvent of water and alcohol or some other chemical compounds, those that can be dissolved into an organic solvent. Examples of such resins non-limitatively include polyvinyl alcohol, cellulosic resins, polyesteric resins, urethanic resins, gelatin, polyacrylamide and polyvinyl pyrrolidone. Any of such resins may be used with one or more than one additives such as a crosslinking agent, a hardening agent, a plasticizer, a modifier and/or a gellant.

For the purpose of the invention, it is necessary to bond organic fine particles by means of the binder, form a film coat and appropriately produce voids among the organic fine particles in the film coat and hence the type of the binder, the physical properties such as glass transition temperature of the resin(s) of the binder and the mixing ratio of the organic fine particles to the binder are highly significant. Since a water-absorbing binder is used for the purpose of the invention, the ink absorbing effect of the porous organic resin layer can be improved by the binder in the porous organic resin layer in addition to the effect of the voids of drawing the solvent of the applied ink into them. Therefore, the balance of the formation of voids and the ink-absorption of the binder is important for the purpose of the invention. Furthermore, according to the invention, the water-absorbing binder does not lose its water-resistance because the voids in the porous organic resin layer satisfactorily operate to absorb ink and moisture so that, when recording images on the recording medium by means of pigment ink, cracks are effectively prevented from appearing in the solid areas of the ink.

Any of the above listed dispersions, or the resin emulsions, is preferably used for the binder of the porous organic resin layer of a recording medium according to the invention. By using such a binder, the binder can remain uniformly among the organic fine particles when drying the porous organic resin layer to produce a film coat. What is more advantageous, the binder is held in a molten state but does not fill the voids. Unlike the organic fine particles, the binder preferably show a glass transition temperature that gives the binder a set of temperature characteristics that are effective for quickly melting it. Specifically, the glass transition temperature of the binder is preferably between −40° C. and 40° C. Additionally, the binder preferably shows a gelation property so that any possible migration of the binder may be blocked in order to prevent it from filling the voids. More preferably, the binder is heat sensitive in terms of its gelation effect.

The particles of the resin emulsion preferably have a diameter found within a range between 20 nm and 500 nm. If they have a diameter lower than the above range, the resin emulsion behaves like resin dissolved in the solvent to occasionally make it impossible to gradually dissolve the resin emulsion arranged among the organic fine particles during the drying process and secure a sufficient volume for the voids. If, on the other hand, they have a diameter higher than the above range, the voids can show unevenness in terms of distribution and size. More preferably, the particles of the resin emulsion have a diameter found within a range between 30 nm and 200 nm. Note that a popular method such as a quasi-elastic laser scattering method (dynamic light scattering method) is used for determining the diameters of the particles of the resin emulsion for the purpose of the invention.

The mixing ratio of the organic fine particles to the binder (P:B ratio) is preferably between 1:1 and 20:1, more preferably between 2:1 and 10:1, in terms of solid contents. As for the absorptive power of the binder, the binder preferably shows an absorptive power that is 0.5 times to 10.0 times, although it may be determined depending on the extent of the stress put on the ink absorbing capacity or the ink absorbing rate thereof. The term "absorptive power" as used herein refers to the volume of ink that the binder absorbs per unit volume thereof.

Of the characteristics of the porous organic resin layer comprising organic fine particles, a binder and voids, the pH value in the layer is also important. A porous inorganic particle layer formed by using a conventional inorganic binder such as alumina or silica and containing voids in the inside shows a relatively low pH value and hence is acidic. However, unlike such an inorganic particle layer, a porous organic resin layer prepared according to the invention can give rise to extreme agglomerates on the surface when ink is applied thereto and the dye of the applied ink can alter their original tints, show a metallic gloss on the surface and become speckled if the pH value is lower than 4.5. According to the invention, the above problem is dissolved by regulating the pH in the inside of the porous organic resin layer to higher than 5.2.

Although the reason for the effect of using a relatively high pH value is not clear, the inventor of the present invention presumes that, when voids are formed in the porous organic resin layer by using organic fine particles, they show a relatively weak absorptive power to the dye of the ink applied thereto unlike the pores of the inorganic fine particles but they are made to quickly absorb ink into therein by appropriately regulating the pH in the layer. The inventor of the present invention has found that the effect of regulating the pH value is closely related to the type of the organic fine particles and the size of the voids in the layer and the ink absorbing effect becomes remarkable when the voids have a size less than 300 nm and even more remarkable when they have a size less than 100 nm. It has also been found by the inventor of the present invention that a more preferable effect can be obtained by regulating the pH value in the porous organic resin layer to between 5.2 and 8.5.

The pH in the porous organic resin layer can be regulated by appropriately selecting the types and the number of the hydrophilic radicals of the resin that is the major ingredient of the organic fine particles and also by appropriately selecting the types and the number of the hydrophilic radicals to be used when emulsifying the binder. Furthermore, the pH in the porous organic resin layer can also be regulated by adding a basic substance such as sodium hydroxide, ammonia or amine when preparing the coating formulation. For the purpose of the invention, the pH in the porous organic resin layer is observed by a method conforming to JIS P 8133.

In a recording medium according to the invention, the porous organic resin layer 102 may be made to contain a slight amount of porous inorganic particles to improve the ink absorption in addition to the above components.

Specific examples of materials that can be used for such porous inorganic particles include silica, alumina hydrate, calcium carbonate, magnesium carbonate, magnesium oxide, kaolin, talc, calcium sulfate, barium sulfate, titania, lead oxide, zinc carbonate, silicic acid, sodium silicate, calcium silicate and clay. Preferably, fine porous inorganic particles of any of the above substances are used in order to provide a sufficient level of transparency for the porous organic resin layer. Specifically, ultra-fine particles of silica or alumina hydrate are preferably be used for the purpose of the invention. Such ultra-fine particles preferably have a diameter less than 100 nm, more preferably less than 10 nm, in terms of primary particles. The content of such porous inorganic particles is preferably between 0.1% and 10% by weight relative to the entire solid contents of the porous organic resin layer. Cracks can occur or transparency can be reduced if the content of inorganic particles exceeds the above level.

A recording medium according to the invention and comprising a base member and a porous organic resin layer formed thereon is obtained by applying a coating formulation that is prepared from organic fine particles, a binder, a basic substance to be used for regulating the pH value and, if desired, porous inorganic particles to the base member and drying the formulation.

As for the physical properties of the coating formulation, the viscosity, the pH and the dispersibility are important. While the viscosity of the coating formulation may be regulated depending on the technique to be used for applying the formulation, it is preferably between 10 cP and 500 cP. In order to produce the above described pH value in the porous organic resin layer, the pH of the coating formulation is preferably made higher than 5.2. The pH value of the coating formulation is observed by a method conforming to JIS Z 8802.

Additionally, the coating formulation is required to provide a sufficient level of dispersibility and preservation stability in order to obtain a uniform film coat and satisfactory transparency. For this purpose, a dispersant, a thickening agent, a lubricant, a fluidity modifying agent, a surfactant, an anti-foaming agent, a water-resisting agent, a foam-inhibitor, a releasing agent and/or anti-mold agent may be added to the coating formulation to such an extent that the addition of any of such agents may not interfere with the object of the present invention.

Techniques that can be used for applying the coating formulation to the base member include blade coating, air knife coating, roll coating, flash coating, gravure coating, kiss coating, dye coating, extrusion, a slide hopper system, curtain coating and spraying.

While the rate at which the coating formulation is applied to the base member may be selected appropriately depending on the application of the recording medium, the ink applied to the porous organic resin layer can blur and/or spill if the rate is too low because the applied ink cannot be satisfactorily absorbed by the layer that is too thin. On the other hand, the strength of the porous organic resin layer can be reduced and/or the film coat can become defective during the application process and/or the drying process to produce areas that cannot satisfactorily absorb ink in the layer if the rate is too high. Additionally, the transparency can be reduced and the recorded images can lose the sharpness if the film coat is too thick. Thus, after drying, the porous organic resin layer preferably has a film thickness between 5 and 50 $\mu$m in order to make it absorb ink satisfactorily and show a reliable strength as a whole.

For the purpose of the invention, the porous organic resin layer is produced by, if necessary, heating and drying the film coat formed on the base member in a manner as described above. As a result of the drying process, when the aqueous medium (dispersant) evaporates, the binder is fused to firmly bind the components together and produce a film layer. The drying conditions may be selected appropriately depending on the composition of the coating formulation. A hot air drying furnace and/or an infrared rays drying furnace that are currently popular may be used for the drying process.

An image forming method according to the invention comprises applying ink to a recording medium according to the invention. Ink to be used for the purpose of the invention contains a coloring agent (dye or pigment), a water-soluble organic solvent and water as principal ingredients. While a water-soluble dye that may be a direct dye, an acidic dye, a basic dye, a reactive dye or a food dye is preferably used, a dye of any type may be used for the purpose of the invention so long as it can produce an image that is satisfactory in terms fixation, coloring, sharpness, stability, light-resistance and other requirements when combined with the recording medium. Examples of pigments that can be used for the purpose of the invention include inorganic pigments such as carbon black, organic pigments, metallic fine particles, oxides of metals and various metal compounds.

The water-soluble dye is generally dissolved in an aqueous solvent that comprises water or a mixture of water and an organic solvent, which is preferably selected from various water-soluble organic solvents. The water content of ink is preferably so regulated as to be found within a range between 20 and 90 weight %.

Water-soluble organic solvents that can be used for the purpose of the invention include alkyl alcohols having 1 to 4 carbon atoms such as methyl alcohol, amides such as dimethylformamide, ketones and ketone alcohols such as acetone, ethers such as tetrahydrofuran, polyaklylene glycols such as polyethylene glycol, alkylene glycols whose alkylene group has 2 to 6 carbon atoms such as ethylene glycol, glycerin and lower alkyl ethers of polyhydric alcohols such as ethylene glycol methyl ether.

Of such various water-soluble organic solvents, polyhydric alcohols such as diethylene glycol and lower alkyl ethers of polyhydric alcohols such as triethylene glycol monomethyl ether and triethylene glycol monoethyl ether are preferable for the purpose of the present invention. The use of a polyhydric alcohol is particularly advantageous because it operates as lubricant for preventing a phenomenon of clogged nozzle from taking place when the water in ink evaporates to deposit, if partly, the water-soluble dye in the ink.

A solubilizing agent may be added to ink. Typical solubilizing agents that can be used for the purpose of the invention include nitrogen-containing heterocyclic ketones because such agents can dramatically raise the solubility of the water-soluble dye to the solvent. For instance, N-methyl-2-pyrrolidone or 1,3-dimethyl-2-imidazolidinone may preferably be used for the purpose of the invention. Furthermore, any of the additives as listed below may be used to improve the performance of ink: a viscosity regulator, a surfactant, a surface tension regulator, a pH regulator and a specific resistance regulator.

An ink-jet recording method is preferably used when recording images by applying ink to a recording medium according to the invention. Any ink-jet recording method can be used for the purpose of the invention if it can effectively release ink from a nozzle and apply ink to the recording medium, although the use of an ink-jet recording method with which ink abruptly changes its volume by thermal energy and becomes discharged from a nozzle by the force generated due to this change of state as disclosed in Japanese Patent Application Laid-Open No. 54-59936 may be a preferable choice.

Any of the different types of ink as listed in 1 through 3 below may be used for recording an image on a recording medium according to the invention.

1. ink containing a dye as coloring agent
2. ink containing a pigment as coloring agent
3. ink containing a mixture of a dye and a pigment or a combination of ink containing a pigment and ink containing a dye When forming an image on a recording medium according to the invention, using inks containing dyes as coloring agents, bleeding (blurring along the boundaries) of solidly printed areas produced by a combination of inks of different colors is remarkably alleviated if compared with the prior art mainly due to the high absorptive power of the recording medium. Additionally, printed areas are substantially relieved of white haze. Furthermore, printed areas and unprinted areas do not show any significant difference in terms of gloss so that an image comparable to that of a photograph can be obtained. When pigments are used as coloring agents to be applied to a recording medium according to the invention, not only the void structure (gap between organic fine particles) but also the water-absorbing binder in the layer captures the pigments and therefore, improved rub-off resistance and water resistance are obtained. When inks containing pigments and dyes as coloring agents are used, any recording medium of the prior art can give rise to a problem that the areas printed with inks containing pigments as coloring agents and those printed with inks containing dyes as coloring agents show a remarkable difference of gloss, whereas a recording medium according to the invention is practically free from any difference of gloss because the pigments are fixed by the void structure and the water-absorbing binder of the porous organic resin layer so that the applied ink is distributed uniformly.

Any of the printing methods listed in 1 through 3 below may be used for the purpose of the present invention in addition to conventional printing methods.

1. Use of inks with different coloring agents such as pigments and dyes in same pixels.
2. Use of three or more than three inks with different densities in terms of the coloring agents contained in the inks in same pixels.
3. Use of a high speed printing method of applying ink highly densely at an enhanced rate in a single scan and reducing the number of passes of the multi-pass process.

An image comparable to that of a photograph can be obtained when inks with different coloring agents such as pigments and dyes are used in same pixels on a recording medium according to the invention. For instance, if black ink containing a black pigment and dye ink are used in same pixels to raise the density of black areas in order to produce a sharp image, practically no bleeding occurs along the boundaries of the different inks nor appears a phenomenon that areas printed with black ink become more glossy than the remaining printed areas so that as a whole an image comparable to that of a photograph can be obtained with little difference of gloss due to the use of different coloring agents. Similarly, when three or more than three inks with different colorant densities are used in same pixels on a recording medium according to the invention in order, for example, to realize a smooth gradation from a highlight portion to a shadow portion by lap application of such inks at an enhanced dot density, the recording medium shows a high absorptive power relative to the inks with no spill of ink occurring in high density areas and little difference of gloss between printed areas and unprinted areas so that an exquisitely fine image can be formed.

Furthermore, a recording medium according to the invention can be used with a high speed printing method of applying ink highly densely at an enhanced rate in a single scan and reducing the number of passes of the multi-pass process. In recent years, there is a growing demand for recording media that can be used with high speed printing methods. A recording medium according to the invention can prevent possible degradation of image quality due to spills and blurs of ink even if a printing method with less number of passes is used and a relatively large amount of ink is applied in a single pass. This is probably because, if a large amount of ink is applied in each pass, the ink applied to a recording medium according to the invention in the first pass is absorbed temporarily into the void structure and the water-absorbing binder keeps on absorbing the ink in the void structure so that the porous organic resin layer maintains a high absorptive power that is sufficient for absorbing the ink applied in the next pass.

Now, the present invention will be described in greater detail by way of examples and comparative examples, although the present invention is by no means limited thereto.

EXAMPLE 1

A recording medium having a configuration as shown in FIG. 1 was prepared. More specifically, a 100 $\mu$m thick transparent PET film (100Q80D: tradename, available from Toray) was used for the base member 101 and a coating formulation for forming a porous organic resin layer 102 on the base member was prepared in a manner as described below. An aqueous dispersion of carboxymethylcellulose nitrate having a nitric ester radical as hydrophobic radical and a carboxylmethyl radical as hydrophilic radical was prepared for organic fine particles by following the process as described below.

Firstly, 40 g of carboxymethylcellulose and 400 $cm^3$ of a mixture of sulfuric acid/nitric acid/water=62.6/25.0/12.4 were mixed and stirred and the product was washed with water, isolated and collected and then dried at 100° C. for an hour to obtain carboxymethylcellulose nitrate. The obtained carboxymethylcellulose nitrate was stirred with water, toluene and an emulsifier by means of a three-one motor to produce a W/O phase. Then, water was further added to shift to an O/W phase and the organic solvent was removed by means of an evaporator to obtain an aqueous dispersion of organic fine particles. The average particle diameter of the organic fine particles was 142 nm and the Tg was 165° C. As observed through a scanning electron microscope (S-5000: tradename, available from Hitachi), it was found that the particles were not spherical in shape but showed a complex profile that was rich in undulations on the surface.

The obtained aqueous dispersion of organic fine particles was diluted until the solid contents became to occupy 10% and mixed with water-absorptive cationic urethane emulsion (absorption factor: 1.6, average particle diameter: 50 nm) to a mixing ratio of 10:1. Then, 25% aqueous ammonia was added to the mixture until it took 3% by weight in the mixture for the purpose of pH regulation in order to obtain the intended coating formulation. The pH of the obtained coating formulation was 6.0.

Figure 2:
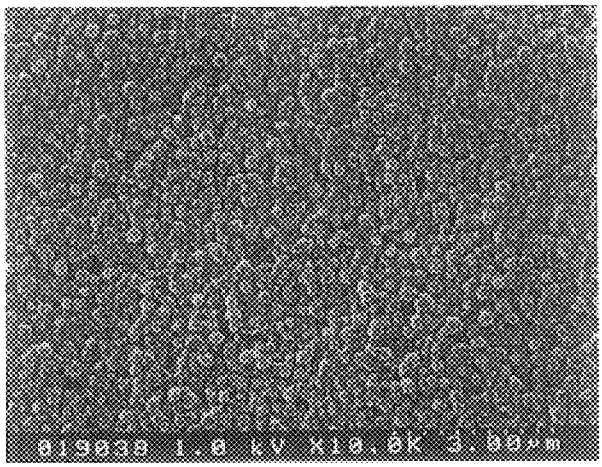
FIG. 2 is an illustrative copy of a microscopic photograph of the porous organic resin layer of the recording medium of Example 1 obtained by observing it through a scanning microscope.

The coating formulation was applied to the surface of the base member by die coating by means of a coating machine and a hot air drying furnace (not shown) and then dried (at drying temperature of 120° C.) to produce a porous organic resin layer 102 showing a film thickness of 30 $\mu$m. The pore structure of the porous organic resin layer was observed for both the surface and a cross section through a scanning electronic microscope (S-5000: tradename, available from Hitachi) to find a pore structure as shown in FIG. 2. Additionally, the highest peak of the pore size distribution curve of the porous organic resin layer was determined (by means of Autosorb 1: tradename, available from Quanthachrome) to find that it was at a pore radius of 30 nm. The pore volume per unit weight of the porous organic resin layer was 0.252 $cm^3/g$ and the pH in the layer was 6.3.

The recording medium 100 was evaluated for the following test items. The results of the evaluation were listed in Table 1. To be more accurate, a number of specimens were prepared and evaluated and any one that was rated by x for at least one of the test items (1) through (4) was evaluated as no good while those that were without x rating were evaluated as good. (evaluation)

(1) transparency

The overall light transmissivity (%) of each specimen of recording medium was observed by means of a haze meter (NDH-100DP: tradename, available from Nihon Denshoku Kogyo) according to JIS K-7105.

(2) tack, fingerprint resistance

A fingerprinting test (of holding the thumb of a bare hand in contact with the surface of the porous organic resin layer of the recording medium for 10 seconds) was conducted on the surface of each specimen to see if the thumb was tacked to the surface and a fingerprint was left there. The specimen was rated as ○ when no fingerprint was found on the surface and as Δ when a fingerprint was slightly found on the surface while it was rated as x when the thumb was tacked to the surface and a fingerprint was clearly found.

(3) blocking effect

Ten specimens of recording medium were laid one on the other, put in a PP bag and stored in environmental conditions of 30° C./80% RH for a month. After the storage, those that were not adhering to each other and could be separated from each other were rated as ○ and those that could not be separated from each other were rated as x.

(4) printing performance

An ink-jet printer comprising a number of drop on demand type ink-jet heads having nozzles arranged at regular intervals (600 dpi) at a rate of 24 nozzles per 1 mm, the number of nozzles being equal to the number of inks to be used for printing, and adapted to form an image by scanning perpendicularly relative to the row of the nozzles was used for an ink-jet recording operation using inks of different compositions as listed below. Each ink was ejected at a rate of 10 pl per dot. The rate of ink consumption for single color printing conducted at a rate of 24×24 dots per 1 $mm^2$ (600 dpi×600 dpi) was regarded as 100%. Therefore, the rate of ink consumption for double color printing was a double of the rate of ink consumption for single color printing and hence regarded as 200%. Similarly, the ink consumption rate for triple color printing and the one for quadruple color printing were regarded respectively as 300% and 400%.

The following coloring agents were used; C. I. Direct Yellow 86 for Y ink, C. I. Acid Red 35 for M ink, C. I. Direct Blue 199 for C ink and C. I. Food Black 2 for Bk ink. Then, each of the coloring agents were used to prepare three different inks with different dye concentrations for each color.

| <1> ink composition 1: | high dye concentration ink |
|---|---|
| the dye | 3 portions |
| diethylene glycol | 5 portions |
| polyethylene glycol | 10 portions |
| water | 82 portions |
| <2> ink composition 2: | medium dye concentration ink |
| the dye | 1 portions |
| diethylene glycol | 5 portions |
| polyethylene glycol | 10 portions |
| water | 84 portions |
| <3> ink composition 2: | low dye concentration ink |
| the dye | 0.6 portions |
| diethylene glycol | 5 portions |
| polyethylene glycol | 10 portions |
| water | 84.4 portions |

Then, ink sets of inks of four colors of yellow (Y), magenta (M), cyan (C) and black (Bk) prepared in the above described manner were used to print images on a recording medium according to the invention and evaluated for the following test items (a) through (g) that relate to the printing effect.

(a) blurring, bleeding, beading, repelling and stripy unevenness

Inks of ink composition 1 were used for printing and the ink consumption rate of ink of each color was changed from 100% (single color) to 400% (quadruple color). The printed image was visually checked for blurring, bleeding, beading, repelling and stripy unevenness. The following rating system was used.

No such defects occurred at ink consumption rate of 400%: ⊚

No such defects occurred at ink consumption rate of 300%: ○

No such defects occurred at ink consumption rate of 100%: Δ

Such defects occurred at ink consumption rate of 100%: x (b) image density

The transmissive image density of each of the images printed solidly by using high dye concentration inks with composition 1 of different colors at an ink consumption rate of 100% (single color) were observed by means of a densitometer (310TR: tradename, available X-Rite) and the image density of each image was expressed by the obtained numerical value.

(c) gradation

Ink sets with ink compositions 1 through 3 were used and the ink consumption rate of each ink set was manipulated to print images with different density levels on a recording medium according to the invention by means of the above ink-jet printing apparatus. More specifically, the image density was changed in about 60 steps and the printed areas of the different density levels were visually observed. An image where the differences of density were recognizable was judged to be showing satisfactory gradations. The number of gradations recognized by this method was counted.

(d) color reproducibility

A single color solid pattern was printed for each of the four colors at an ink consumption rate of 100% and the obtained image was visually observed for color reproducibility (in order to check if any abnormal tint was found). Images with a normal tint were rated as ○, whereas those with an abnormal tint were rated as x.

(e) ink fixation

A solid pattern was printed at an ink consumption rate of 300%. Ten sheets printed such a solid pattern were from the printing apparatus at a rate of a sheet/min. After the end of the printing operation, printed side of each sheet and the rear side of an adjacent sheet were checked for sticking. The sheet carrying the solid pattern was rated as ○ if it was not sticking to the rear side of the adjacent sheet, whereas it was rated as x if it was sticking the rear side of the adjacent sheet.

(f) water-resistance

A solid pattern was printed on a sheet of recording medium according to the invention at an ink consumption rate of 200% for each color and left for a day to make the ink dry. Thereafter, the sheet carrying the pattern was immersed in pure water for 3 minutes to see if the ink had flown out and the ink receiving layer had been dissolved, if partly. Sheets that showed no such ink flow nor any dissolved ink receiving layer were rated as ○, whereas those that showed such an ink flow and a dissolved ink receiving layer were rated as x.

(g) OHP transparency

Each printed sheet was used with a reflection type overhead projector and checked if the sheet casted its shadow to a recognizable extent or not. Sheets whose shadows were not recognizable were rated as ○, whereas those whose shadows were recognizable were rated as x.

Comparative Example 1

Specimens of recording medium were prepared as in Example 1 except that the binder was replaced by water-soluble polyvinyl alcohol and the pH was not regulated. The obtained specimens were used for image formation as in Example 1 and evaluated for items (1) through (4). Table 1 summarily shows the results.

Figure 3:
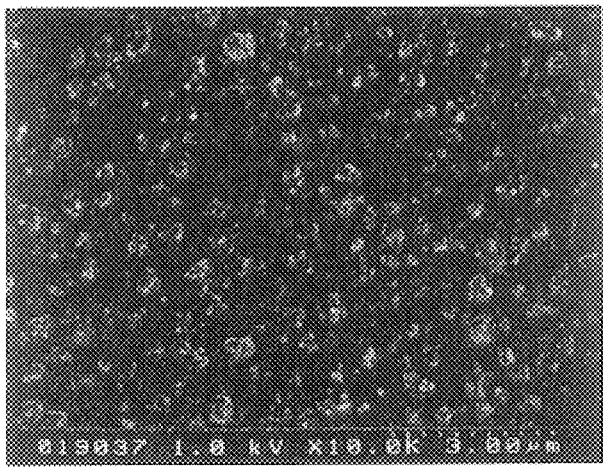
FIG. 3 is an illustrative copy of a microscopic photograph of the recording medium of Comparative Example 1 obtained by observing it through a scanning microscope.

The porous organic resin layer of each of the sheets of the specimens was observed through a scanning electron microscope (S-5000: tradename, available from Hitachi) for both the surface and a cross section to find that the pore structure was not satisfactory as shown in FIG. 3. Additionally, the highest peak of the pore size distribution curve of the porous organic resin layer was determined (by means of Autosorb 1: tradename, available from Quanthachrome) to find that it was at a pore radius of 2 nm. The pore volume per unit weight of the porous organic resin layer was 0.052 $cm^3/g$ and the pH in the layer was 4.3.

Comparative Example 2

Figure 4:
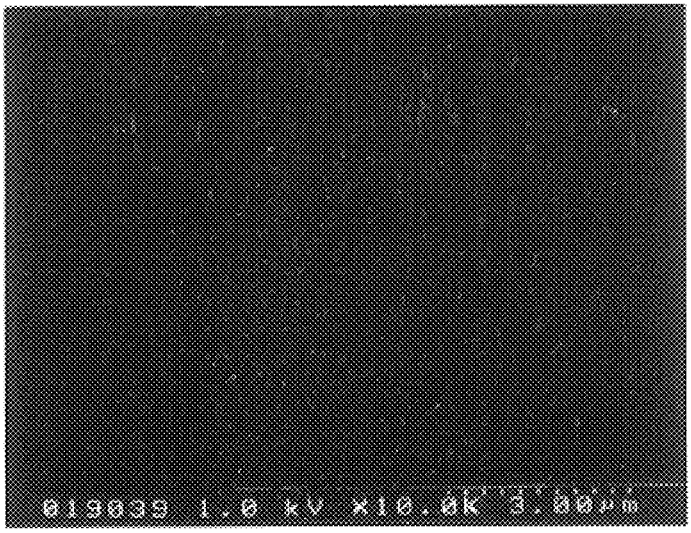
FIG. 4 is an illustrative copy of a microscopic photograph of the recording medium of Comparative Example 4 obtained by observing it through a scanning microscope.

Specimens of recording medium were prepared as in Example 1 except that they did not contain any organic fine particles (and hence contained only a water-absorbing binder). The obtained specimens were used for image formation as in Example 1 and evaluated for items (1) through (4). Table 1 summarily shows the results. The ink receiving layer of each of the sheets of the specimens was observed through a scanning electron microscope (S-5000: tradename, available from Hitachi) for both the surface and a cross section to find that any pore structure was not found as shown in FIG. 4.

Comparative Example 3

Specimens of recording medium were prepared as in Example 1 except that the organic fine particles were replaced by porous inorganic particles of alumina hydrate and polyvinyl alcohol was used for the binder to prepare a coating formulation by using the process as described below, which was then applied onto the base material to produce a recording medium as in Example 1. The obtained specimens were used for image formation as in Example 1 and evaluated for items (1) through (4). Table 1 summarily shows the results.

For preparing the coating formulation, firstly aluminum dodexide was formed by using the method as described in U.S. Pat. No. 4,242,271. Then, the obtained aluminum dodexide was hydrolysed to produce alumina slurry. Water was then added to the alumina slurry until the solid content of alumina hydrate fell to 7.9%. The alumina slurry showed a pH value of 9.4. Then, 3.9% aqueous solution of nitric acid was added to regulate the pH and, after an aging process, colloidal sol was obtained. The colloidal sol was dried by spraying at the inlet temperature of 83° C. to produce powdery alumina hydrate having a boemite structure. The alumina hydrate was dispersed into deionized water to produce a 15% solution. Thereafter, polyvinyl alcohol (Gohsenol GH17: tradename, available from Nihon Gohsei Kagaku Kogyo) was dissolved in deionized water to produce a 10% solution. The alumina hydrate and the polyvinylalcohol solution was mixed to a mixing ratio of 7:1 by weight as reduced to solid and stirred to obtain the coating formulation of the example.

Figure 5:
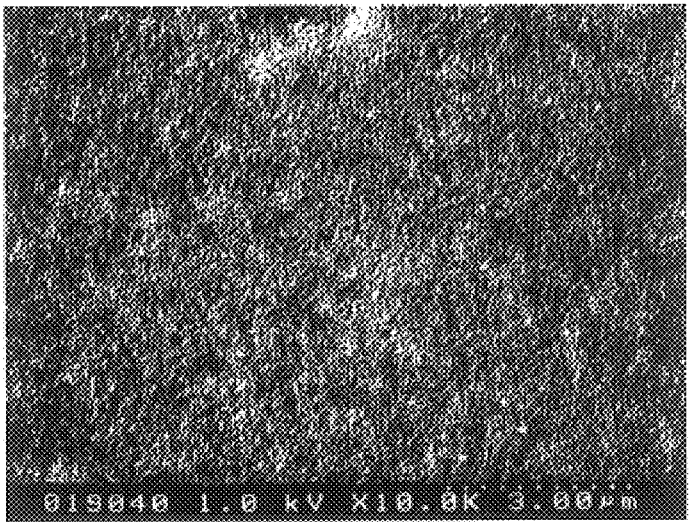
FIG. 5 is an illustrative copy of a microscopic photograph of the recording medium of Comparative Example 3 obtained by observing it through a scanning microscope.

The obtained coating formulation was applied to the surface of the base film by die coating by means of a coating machine and a hot air drying furnace (not shown) and then dried at drying temperature of 140° C. to produce an ink receiving layer 102 showing a film thickness of 40 $\mu$m. The highest peak of the pore size distribution curve of the ink receiving layer 102 was at a pore radius of 2 nm. The pore volume per unit weight of the ink receiving layer of the sheet was 0.54 $cm^3/g$ and the pH in the layer was 4.3. The ink receiving layer of the sheet was observed through a scanning electron microscope (S-5000: tradename, available from Hitachi) for both the surface and a cross section to find that a pore structure as shown in FIG. 5 was found.

EXAMPLE 2

A recording medium was prepared as in Example 1 except that fine particles of crosslinked acrylamide were used for organic fine particles. The obtained specimens of recording medium were used for image formation as in Example 1 and evaluated for items (1) through (4). Table 1 summarily shows the results.

The fine particles of crosslinked acrylamide used in this example were prepared in a manner as described below. Firstly, 60 portions of acrylamide, 20 weight portions of methylene bis-acrylamide operating as crosslinking component and 20 weight portions of methcrylic acid added as particle size regulator in ethanol to produce an ethanol dispersion of organic fine particles. Then, pure water was added to the dispersion until the mixing ratio of water to ethanol became equal to 1:1 and the mixture was stirred thoroughly by means of an agitator. The obtained organic fine particles showed an average particle diameter of 142 nm and a Tg value of 165° C. When the particles were observed through a scanning electron microscope (S-5000: tradename, available from Hitachi), they were porous particles carrying fine pores on the surface. The porosity of the particles was determined to be equal to 0.353 $cm^3/g$ by a nitrogen adsorption/desorption method.

Then, the obtained organic fine particles were mixed with a binder same as the one used in Example 1 and the mixture was stirred to produce the coating formulation of this example. Thereafter, sheet specimens of recording medium were prepared by using the coating formulation as in Example 1.

The porous organic resin layer of each of the obtained sheet specimens was observed through a scanning electron microscope (S-5000: tradename, available from Hitachi) for both the surface and a cross section to find a pore structure. Additionally, the highest peak of the pore size distribution curve of the porous organic resin layer was determined (by means of Autosorb 1: tradename, available from Quanthachrome) to find that it was at a pore radius of 29 nm. The pore volume per unit weight of the porous organic resin layer was 0.452 $cm^3/g$ and the pH in the layer was 6.3.

EXAMPLE 3

In this example, ink sets of pigment inks containing pigments as coloring agents were used for recording images on specimens of recording medium same as those obtained in Example 1. The following coloring agents, or pigments, were used; C. I. Pigment Yellow 83 for Y ink, C. I. Pigment Red 48:3 for M ink, C. I. Pigment Blue 15:3 for C ink and carbon black for Bk ink. Then, each of the coloring agents were used to prepare three different inks with different dye concentrations for each color.

The pigment inks were prepared firstly by preparing pigment dispersions, using a pigment dispersant as shown below and a known dispersion method. Then, inks of different colors were prepared by using the pigment dispersions.

| | |
|---|---|
| the pigment | 15 portions |
| copolymer of polyethylene glycol monoacrylate to which an oxyethylene radical was introduced by 45 mols and sodium acrylate [monomer mol ratio (the former/the latter) = 2/8] | 3 portions |
| monoethanol amine | 1 portion |

Inks of different colors with different pigment concentrations were prepared by using the above pigment dispersant solution.

| <4> ink composition 4: | high pigment concentration |
|---|---|
| the pigment dispersion | 33 portions |
| deionized glycol | 4 portions |
| deionized water | 63 portions |
| <5> ink composition 5: | medium pigment concentration |
| the pigment dispersion | 11 portions |
| diethylene glycol | 4 portions |
| deionized water | 85 portions |
| <6> ink composition 6: | high pigment concentration |
| the pigment dispersion | 6.6 portions |
| diethylene glycol | 4 portions |
| deionized water | 89.4 portions |

Then, ink sets of inks prepared in the above described manner were used to print images on a recording medium according to the invention and evaluated for the test items (1) through (4) as in Example 1 as well as the following items (5) and (6). Table 2 summarily shows the obtained results.

(5) fixation of coloring agent

High concentration inks of composition 4 above of different colors were used to print solid patterns at an ink consumption rate of 100% (single color) by means of the above recording apparatus and, after drying the ink, the printed areas were rubbed by a finger tip to check for any release of the coloring agent. The sheet without any release of the coloring agent was rated as ○ whereas the sheet that released the coloring agent was rated as x.

(6) cracks in the coloring agent in solidly printed areas

Inks of composition 4 above with different colors were used to print solid patterns at an ink consumption rate of 100% (single color) by means of the above recording apparatus and, the printed areas were observed through an optical microscope (not shown) to check for cracks in those areas. The sheet without any cracks was rated as ○ whereas the sheet that showed cracks was rated as x.

EXAMPLE 4

In this example, a combination of pigment ink and dye ink was used to print an image on a recording medium as in Example 1. More specifically, ink sets using the dye inks prepared in Example 1 was used for Y, M and C, while ink sets using the pigment inks prepared in Example 3 were used for Bk for the image formation using the above recording apparatus. The specimens were evaluated for (1) through (6) as in Example 3. Ink set of high concentration inks was used for the evaluation of (5) and that of (6) above. The obtained results are summarily shown in Table 2.

EXAMPLE 5

In this example, ink sets of inks using a coloring agent that is a mixture of a pigment and a dye as shown below were used for image formation on a recording medium as in Example 1. Dyes in Example 1 were also used in this example and pigment dispersions of Example 3 were used here.

| <7> ink composition 7: | dye/pigment mixture high concentration |
|---|---|
| dye | 1.5 portions |
| pigment dispersion | 16.5 portions |
| diethylene glycol | 4.5 portions |
| polyethylene glycol | 5 portions |
| water | 72.5 portions |

| <8> ink composition 8: | dye/pigment mixture medium concentration |
|---|---|
| dye | 0.5 portions |
| pigment dispersion | 5.5 portions |
| diethylene glycol | 4.5 portions |
| polyethylene glycol | 5 portions |
| water | 84.5 portions |

| <9> ink composition 9: | dye/pigment mixture low concentration |
|---|---|
| dye | 0.3 portions |
| pigment dispersion | 3.3 portions |
| diethylene glycol | 4.5 portions |
| polyethylene glycol | 5 portions |
| water | 86.9 portions |

The specimens of this example were evaluated for items (1) through (6) as in Example 3. Ink sets of Bk, Y, M and C high concentration inks were used for the evaluation of (5) and that of (6) above. The obtained results are summarily shown in Table 2.

As described above, according to the invention there is provided a recording medium that is highly excellent in terms of ink absorption rate, prevention of sticking, transparency, fixation of pigment ink, color reproducibility of dye ink, water-resistance and ink fixation as well as color density and the number of gradations of the image formed thereon. There are also provided a method of manufacturing such a recording medium and a recording method adapted to record images on the recording medium.

TABLE 1

| Items | | | Ex. 1 | Comp. Ex. 1 | Comp. Ex. 2 | Comp. Ex. 3 | Ex. 2 |
|---|---|---|---|---|---|---|---|
| (1) Transparency | | | ○ | ○ | ○ | Δ | ○ |
| (2) Tack, Finger print resistance | | | ○ | Δ | x | Δ | ○ |
| (3) Blocking effect | | | ○ | x | x | Δ | ○ |
| (4) Printing performance | (a) | Blurring, etc. | ○ | Δ | Δ | ◎ | ◎ |
| | (b) | Image density | 1.56 | 1.52 | 1.50 | 1.56 | 1.58 |
| | (c) | Gradation | 40 | 30 | 30 | 40 | 40 |
| | (d) | Color reproducibility | ○ | x | ○ | ○ | ○ |
| | (e) | Ink fixation | ○ | x | x | ○ | ○ |
| | (f) | Water resistance | ○ | x | x | ○ | ○ |
| | (g) | OHP transparency | ○ | ○ | ○ | x | ○ |
| Evaluation | | | Good | No good | No good | No good | Good |

TABLE 2

| Items | | | Ex. 3 | Comp. Ex. 4 | Comp. Ex. 5 | Ex. 4 | Ex. 5 |
|---|---|---|---|---|---|---|---|
| (1) Transparency | | | ○ | ○ | Δ | ○ | ○ |
| (2) Tack, Finger print resistance | | | ○ | Δ | Δ | ○ | ○ |
| (3) Blocking effect | | | ○ | x | Δ | ○ | ○ |
| (4) Printing performance | (a) | Blurring, etc. | ○ | Δ | ○ | ○ | ○ |
| | (b) | Image density | 2.49 | 2.48 | 2.56 | 2.46 | 2.52 |
| | (c) | Gradation | 40 | 30 | 40 | 40 | 40 |
| | (d) | Color reproducibility | ○ | x | ○ | ○ | ○ |
| | (e) | Ink fixation | ○ | x | ○ | ○ | ○ |
| | (f) | Water resistance | ○ | x | ○ | ○ | ○ |
| | (g) | OHP transparency | ○ | ○ | x | ○ | ○ |
| (5) Flaxation of colorant (pigment) | | | ○ | ○ | x | ○ | ○ |
| (6) Crack | | | ○ | x | ○ | ○ | ○ |
| Evaluation | | | Good | No good | No good | Good | Good |

What is claimed is:

1. A recording medium comprising:

a base member and at least a porous organic resin layer on said base member;

said porous organic resin layer including organic fine particles having both hydrophilic and hydrophobic groups, and a water-absorbing but water-insoluble resinous binder;

wherein said porous organic resin layer has a pore size distribution having the highest peak found within the pore radius range between 3 nm and 300 nm, a pore volume of 0.2 $cm^3/g$ to 1.0 $cm^3/g$ and a pH value of 5.2 to 8.5 as observed by a method conforming to JIS P 8133.

2. A recording medium according to claim 1, wherein said hydrophilic groups are selected from the group consisting of carboxyl, sulfo, hydroxide, phospho, amino, amido and ethyleneimine radicals.

3. A recording medium according to claim 1, wherein said hydrophobic groups are selected from the group consisting of ester, allyl, vinyl and propenyl radicals.

4. A recording medium according to claim 1, wherein the glass transition temperature of the organic fine particles is between 120° C. and 220° C.

5. A recording medium according to claim 1, wherein the average particle diameter of the organic fine particles is between 5 nm and 250 nm.

6. A recording medium according to claim 1, wherein said organic fine particles are not spherical.

7. A recording medium according to claim 1, wherein said organic fine particles have voids therein.

8. A recording medium according to claim 1, wherein said water-absorbing binder is cationic or nonionic.

9. A recording medium according to claim 1, wherein said base member is a transparent base member.

10. An image forming method for forming an image by applying ink to a recording medium, wherein said recording medium is according to any of claims 1 through 9.

11. An image forming method according to claim 10, wherein an ink-jet recording method is used for applying ink to the recording medium.

12. An image forming method according to claim 11, wherein said ink-jet recording method is a method of discharging ink droplets by applying thermal energy to ink.

13. An image forming method according to claim 10, wherein the ink comprises dyes and/or pigments.

* * * * *

UNITED STATES PATENT AND TRADEMARK OFFICE

CERTIFICATE OF CORRECTION

PATENT NO. : 6,686,000 B2
DATED : February 3, 2004
INVENTOR(S) : Hirofumi Ichinose It is certified that error appears in the above-identified patent and that said Letters Patent is hereby corrected as shown below:

Title page,
Item [56], References Cited, FOREIGN PATENT DOCUMENTS,
"10-324053 A 12/1997" should read -- 10-324053 A 12/1998 --.

Column 3,
Line 45, "terms" should read -- terms of --

Column 4,
Line 59, "utilizes" should read -- utilized --.

Column 5,
Line 7, "operate" should read -- operates --.

Column 7,
Line 42, "ejected" should read -- ejection --.

Column 8,
Line 31, "additives" should read -- additive --.
Line 62, "show" should red -- shows --.

Column 10,
Line 21, "preferably" should read -- preferably to --.

Column 11,
Line 32, "terms" should read -- terms of --.
Line 48, "polyaklylene" should read -- polyalkylene --

Column 15,
Line 28, "composition 2:" should read -- composition 3: --.

Column 16,
Line 18, "printed" should read -- printed with -- and "were" should read -- were outputted --.
Line 24, "sticking" should read -- sticking to --.

Column 17,
Line 62, "methcrylic" should read -- methacrylic --.

UNITED STATES PATENT AND TRADEMARK OFFICE

CERTIFICATE OF CORRECTION

PATENT NO. : 6,686,000 B2
DATED : February 3, 2004
INVENTOR(S) : Hirofumi Ichinose It is certified that error appears in the above-identified patent and that said Letters Patent is hereby corrected as shown below:

Column 18,
Line 53, “deionized” should read -- diethylene --.

Signed and Sealed this

Eighth Day of June, 2004

JON W. DUDAS
*Acting Director of the United States Patent and Trademark Office*